US009646779B2

(12) United States Patent
Ricciuti et al.

(10) Patent No.: US 9,646,779 B2
(45) Date of Patent: May 9, 2017

(54) CIRCUIT BREAKERS WITH POLARITY SENSITIVE SHUNT TRIP MECHANISMS AND METHODS OF OPERATING THE SAME

(71) Applicant: Eaton Corporation, Cleveland, OH (US)

(72) Inventors: Anthony Thomas Ricciuti, Bethel Park, PA (US); Daniel Evan Palmieri, Coraopolis, PA (US)

(73) Assignee: Eaton Corporation, Cleveland, OH (US)

( * ) Notice: Subject to any disclaimer, the term of this patent is extended or adjusted under 35 U.S.C. 154(b) by 120 days.

(21) Appl. No.: 14/574,819

(22) Filed: Dec. 18, 2014

(65) Prior Publication Data

US 2016/0181039 A1 Jun. 23, 2016

(51) Int. Cl.

| | |
|---|---|
| ***H01H 51/22*** | (2006.01) |
| ***H01H 9/24*** | (2006.01) |
| ***H01H 71/24*** | (2006.01) |
| ***H01H 83/20*** | (2006.01) |

(52) U.S. Cl.

CPC ..... *H01H 9/24* (2013.01); *H01H 71/2463* (2013.01); *H01H 83/20* (2013.01)

(58) Field of Classification Search

CPC ..... H01H 71/525; H01H 71/2472; H01H 1/2058; H01H 71/505; H01H 71/0228

USPC ..... 335/172–176, 78, 84

See application file for complete search history.

(56) References Cited

U.S. PATENT DOCUMENTS

| | | | | |
|---|---|---|---|---|
| 3,070,682 | A * | 12/1962 | Yarrick | H01H 71/46 200/267 |
| 3,129,358 | A * | 4/1964 | Harbaugh | H01H 75/04 335/28 |
| 5,740,003 | A * | 4/1998 | Seymour | H01H 83/20 335/38 |

OTHER PUBLICATIONS

Cutler-Hammer I.B. 32-255-1F *Instructions for Installation, Operation and Maintenance of Type VCP-W Vacuum Circuit Breakers*, 65 pages (Eaton Corp., Jan. 2000).

* cited by examiner

*Primary Examiner* — Bernard Rojas
(74) *Attorney, Agent, or Firm* — Myers Bigel, P.A.

(57) ABSTRACT

A circuit breaker includes at least one set of breaker contacts and a contact actuating mechanism configured to open and close the at least one set of contacts. The circuit breaker further includes a polarity sensitive shunt trip mechanism mechanically coupled to the contact actuating mechanism and configured to lock the contact actuating mechanism responsive to a shunt trip voltage of a first polarity to prevent closing of the at least one set of contacts and to unlock the contact actuating mechanism responsive to a shunt trip voltage of a second polarity to enable closing of the at least one set of breaker contacts.

17 Claims, 6 Drawing Sheets

CLOSED POSITION

CLOSED POSITION

TRIPPED (OPEN) POSITION

CIRCUIT BREAKERS WITH POLARITY SENSITIVE SHUNT TRIP MECHANISMS AND METHODS OF OPERATING THE SAME

BACKGROUND

The inventive subject matter relates to circuit breakers and methods of operating the same and, more particularly, to circuit breakers with shunt trip mechanisms.

A circuit breaker typically includes at least one set of contacts and a contact actuator mechanism configured to open and close the contacts. Some circuit breakers include shunt trip mechanisms, which may be used to activate the contact actuator responsive to an externally supplied control voltage. An example of a circuit breaker incorporating such a shunt trip mechanism is the Eaton Type VCP-W medium voltage circuit breaker described in *Cutler-Hammer I. B.* 32-255-1*F Instructions for Installation, Operation and Maintenance of Type VCP-W Vacuum Circuit Breakers* (Eaton Corp., January 2000).

In some electrical distribution applications, it may be desirable to lock out a circuit breaker to prevent accidental closure of its contacts. For example, it may be desirable to prevent closure of a circuit breaker when performing maintenance or other operations in which personnel may be near circuitry fed by the circuit breaker.

SUMMARY

Some embodiments of the inventive subject matter provide a circuit breaker including at least one set of breaker contacts and a contact actuating mechanism configured to open and close the at least one set of contacts. The circuit breaker further includes a polarity sensitive shunt trip mechanism mechanically coupled to the contact actuating mechanism and configured to lock the contact actuating mechanism responsive to a shunt trip voltage of a first polarity to prevent closing of the at least one set of contacts and to unlock the contact actuating mechanism responsive to a shunt trip voltage of a second polarity to enable closing of the at least one set of breaker contacts.

In some embodiments, the shunt trip mechanism may include an actuator member configured to engage the contact actuating mechanism, an electromagnet configured to receive the shunt trip voltages and to move the actuator member responsive thereto, and a locking device configured to impede movement of the actuator member. The locking device may be configured to be magnetically actuated by the electromagnet.

In further embodiments, the actuator member may include an arm having an end that engages a moveable member of the contact actuating mechanism. The electromagnet may be configured to attract the arm to pivot the arm about a pivot point to move the moveable member from a first position to a second position. The locking device may be configured to constrain the arm to maintain the moveable member in the second position.

In still further embodiments, the shunt trip mechanism may include a shaft, and the electromagnet may include a coil disposed proximate a first end of the shaft. The arm may include a plate having a first portion on a first side of a pivot point configured to engage the moveable member and a second portion on a second side of the pivot point and having an opening therein through which the shaft passes such that the opening moves along the shaft as the plate pivots. The locking device may be configured to impede movement of the second portion of the plate with respect to the shaft. The locking device may include a flexible member disposed along the shaft and having a toothed portion extending therefrom in a direction perpendicular to an axis of the shaft and a magnetic slide disposed on the shaft and configured to be drawn along the shaft towards the coil responsive to the shunt trip voltage of the first polarity to thereby displace the toothed portion of the flexible member away from the shaft and thereby engage the second portion of the plate with the toothed portion and to be forced away from the coil along the shaft responsive to the shunt trip voltage of the second polarity to release the flexible member and disengage the toothed portion from the second portion of the plate.

Still further embodiments provide a shunt trip mechanism including an actuator member configured to engage a contact actuating mechanism, an electromagnet configured to move the actuator member from a first position to a second position responsive to a shunt trip voltage of a first polarity, and a locking device configured to lock the actuator member in the second position. The locking device may be configured to be actuated by the electromagnet.

Some embodiments provide methods of operating a circuit breaker. The methods include applying a shunt trip voltage of a first polarity to a shunt trip mechanism to actuate a contact actuating mechanism, locking the contact actuating mechanism using the shunt trip mechanism to prevent closing of at least one set of contacts controlled by the contact actuating mechanism, and releasing the contact actuating mechanism by applying a shunt trip voltage of a second polarity to the shunt trip mechanism.

DETAILED DESCRIPTION

Figure 1:
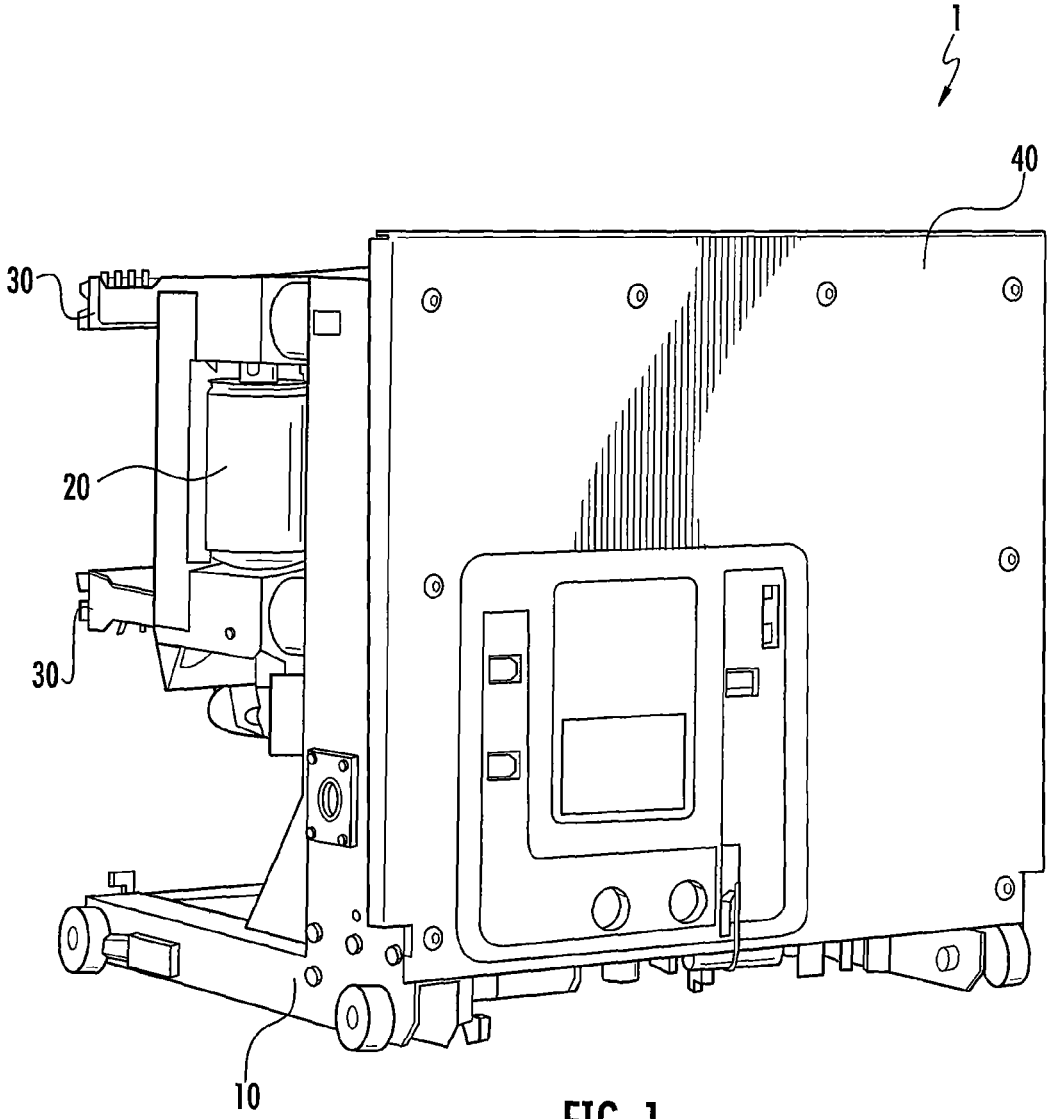
FIGS. 1 and 2 are views of a circuit breaker according to some embodiments of the inventive subject matter.

Specific exemplary embodiments of the inventive subject matter now will be described with reference to the accompanying drawings. This inventive subject matter may, however, be embodied in many different forms and should not be construed as limited to the embodiments set forth herein; rather, these embodiments are provided so that this disclosure will be thorough and complete, and will fully convey the scope of the inventive subject matter to those skilled in the art. In the drawings, like numbers refer to like elements. It will be understood that when an element is referred to as being "connected" or "coupled" to another element, it can be directly connected or coupled to the other element or intervening elements may be present. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless expressly stated otherwise.

It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

Some embodiments of the inventive subject matter arise from a realization that lockout of a circuit breaker may be achieved by using a polarity-sensitive shunt trip mechanism that can be used to lock out the breaker contacts until a shunt trip voltage of a certain polarity is applied to the shunt trip mechanism. In some embodiments, the shunt trip mechanism may include a locking device that is actuated by an electromagnet used to actuate the mechanism. For example, the locking device may include a magnetic latch or similar feature that restrains movement of an actuator plate of the shunt trip mechanism that engages a contact actuator mechanism of the breaker, thus preventing movement of the contact actuator and closure of the breaker contacts until the magnetic latch is released.

Embodiments of the inventive subject matter are described below with reference to medium voltage vacuum circuit breakers. It will be appreciated, however, that the inventive subject matter is not limited to such applications, and is widely applicable to a wide variety of different types of circuit breakers and other switching devices that employ shunt trip mechanisms.

Figure 2:
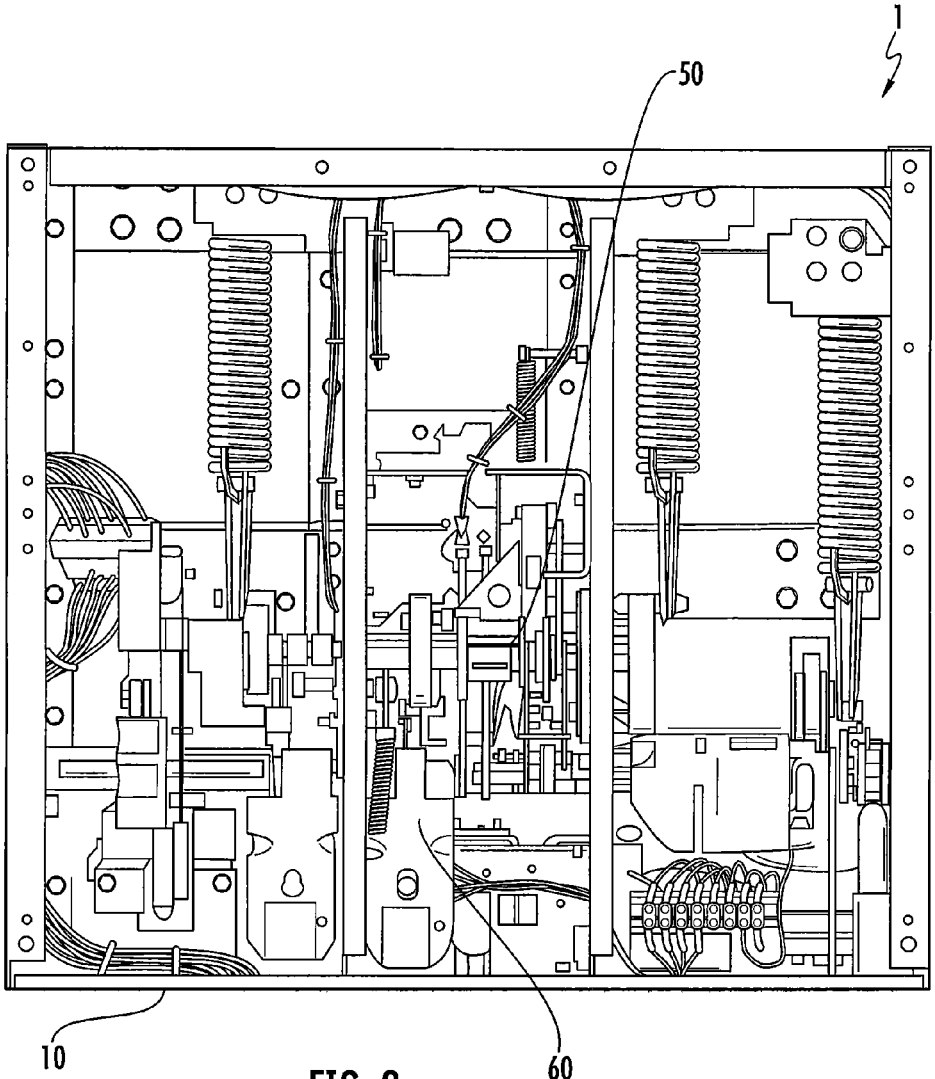
Figure 3A:
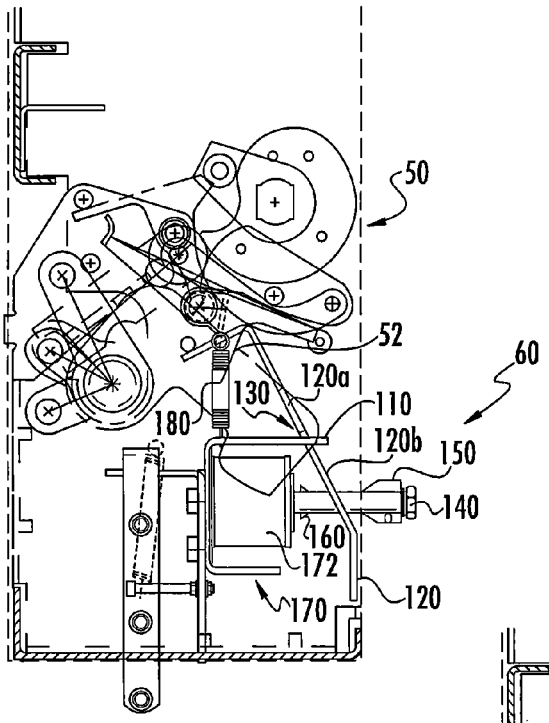
FIGS. 3A and 3B are detailed views illustrating a shunt trip mechanism and operations thereof for the circuit breaker of FIGS. 1 and 2 according to some embodiments.
Figure 3B:
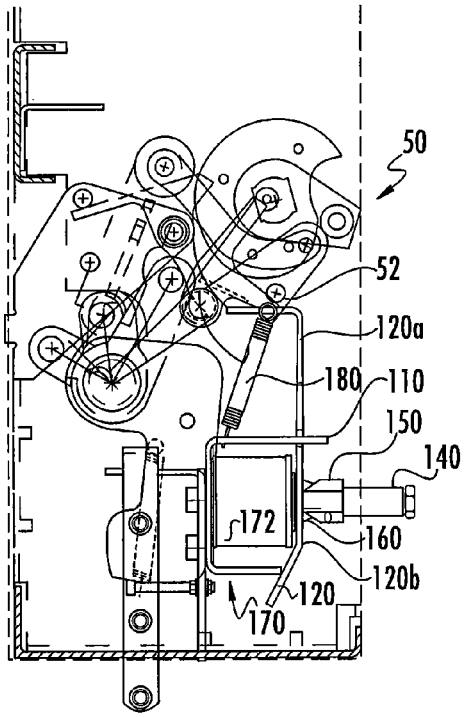
Figure 4:
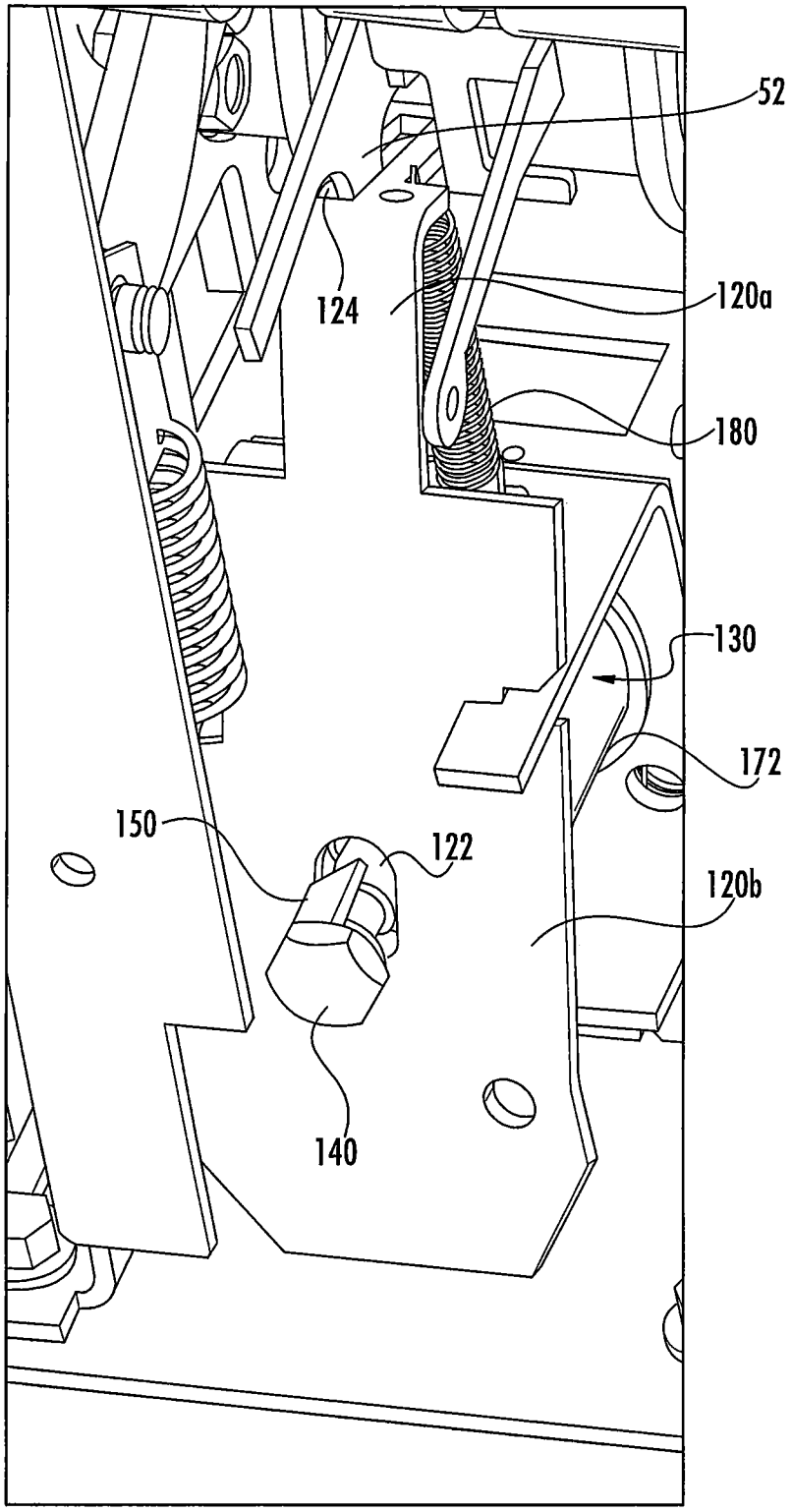
FIG. 4 is a detailed perspective view of the shunt trip mechanism of FIGS. 3A and 3B.
Figure 5A:
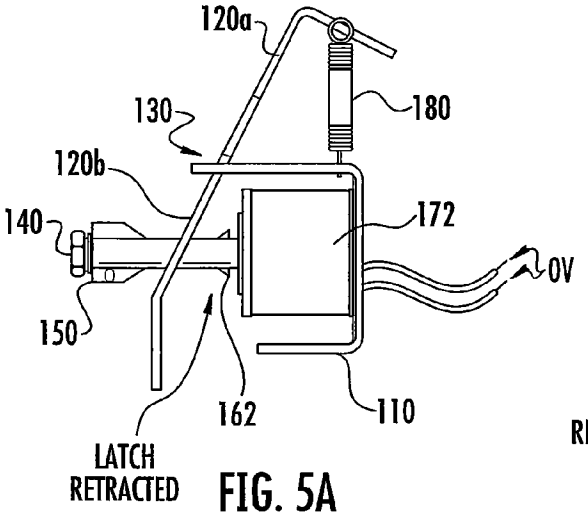
FIGS. 5A-C are detailed views illustrating operations of the shunt trip mechanism of FIGS. 3A and 3B.
Figure 5B:
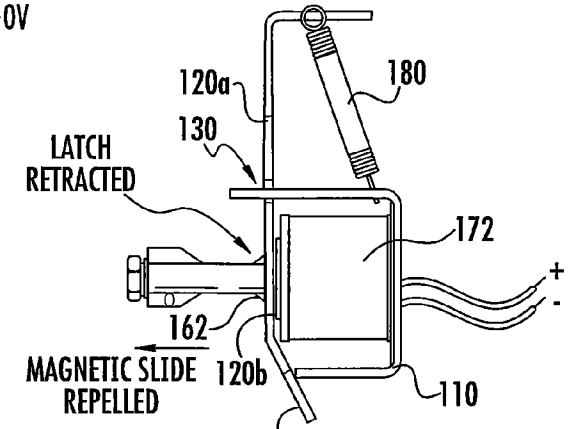
Figure 5C:
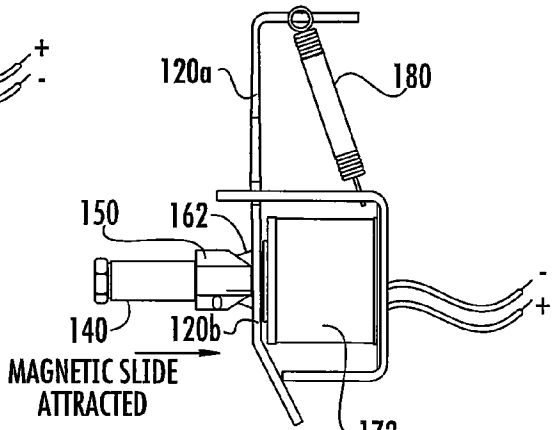

FIG. 1 is a perspective view of a vacuum circuit breaker 1 in which some embodiments of the inventive subject matter may be implemented. The circuit breaker 1 includes a frame 10 configured to support a combination of electromechanical and electronic components. A plurality of vacuum circuit interrupters 20, which include breaker contacts, are supported by the frame 10 and are configured to be electrically connected to bus bars using stab contacts 30. Mechanical and electrical components for controlling the vacuum circuit interrupters 20 are also supported by the frame and disposed behind a front panel 40. FIG. 2 illustrates the circuit breaker 1 with the front panel 40 removed, showing control components for the vacuum circuit interrupters 20 that may include a contact actuator mechanism 50, which is configured to control movement of the contacts of the vacuum circuit interrupters 20 using energy stored in springs and other energy storage devices. According to some embodiments, the control components further include a polarity-sensitive shunt trip mechanism 60, which is mechanically coupled to the contact actuator mechanism 50. As explained in detail below, the polarity-sensitive shunt trip mechanism is configured to lock the contact actuating mechanism 50 to prevent closing of the contacts of the vacuum circuit interrupters 20 responsive to a shunt trip voltage of a first polarity and to unlock the contact actuating mechanism 50 responsive to a shunt trip voltage of a second polarity to enable closing of the contacts of the vacuum circuit interrupters 20.

FIGS. 3A, 3B, 4, 5A, 5B and 5C are detailed views of the contact actuator assembly 50 and shunt trip mechanism 60 of FIG. 2. The shunt trip mechanism includes a frame 110 supported by the circuit breaker frame. A shaft 140 is supported by the frame 110. An electromagnet 17Q is mounted on the frame, and includes a coil 172 mounted coaxially with the shaft 140. The coil 172 is configured to receive a shunt trip voltage from a source external to the circuit breaker, which causes the electromagnet to exert magnetic force.

The shunt trip mechanism 60 further includes a shunt trip plate 120 (or "clapper") that is actuated by the electromagnet 170. In particular, the shunt trip plate 120 is configured to pivot around a pivot point 130 supported by the frame 110. An upper portion 120*a* of the shunt trip plate 120 is configured to engage a protruding member 52 of the contact actuator mechanism 50. A lower portion 1201) of the shunt trip plate 120 has an opening 122 therein through which the shaft 140 passes. When the coil 172 of the electromagnet 170 is energized using a shunt trip voltage of a first polarity, the lower portion 120*b* of the shunt trip plate 120 is drawn towards the coil 172 (opposing a force generated by a spring 180), causing the shunt trip plate 120 to pivot about the pivot point 130. This causes the upper portion 120*a* of the shunt trip plate 120 to move the protruding arm 52 of the contact actuator mechanism 50 laterally, which, in turn, causes the contact actuator mechanism 50 to trip and open the contacts of the vacuum circuit interrupters 20.

The shunt trip mechanism 60 further includes a magnetic locking device. As shown, magnetic locking device includes a magnetic slide 150 that operates a catch in the form of one or more toothed flexible members 160 disposed along the shaft 140. The magnetic slide 150 may include one or more beveled faces 152 that, when the slide 150 is drawn toward the coil 172, deflect the members 160 away from the shaft 140 such that toothed portions 162 of the flexible members 160 engage a surface of the lower portion 120*b* of the shunt trip plate 120 adjacent the opening 122. This locks the shunt trip plate 120 against the coil 172, preventing movement of the protruding arm 52 of the contact actuator mechanism 50 back to a position that allows closure of the vacuum circuit interrupter contacts. Upon tripping of the breaker, auxiliary contacts that operate in coordination with the main breaker contacts may disconnect the shunt trip voltage source from the coil 172, thus deactivating the electromagnet 170.

The slide 50 may be configured to be frictionally held in the locked position until a shunt trip voltage of a second polarity opposite to the first polarity is applied to the coil 172, generating a repelling magnetic force sufficient to overcome friction and move the slide 150 away from the coil 172. As the slide 150 moves away from the coil 172, the flexible members 160 are released, disengaging the toothed portions 162 from the lower portion 120*b* of the shunt trip plate 120. This allows the shunt trip plate 120 to pivot back to a position that releases the contact actuator mechanism 50, thus enabling the breaker contacts to be closed.

Figure 6:
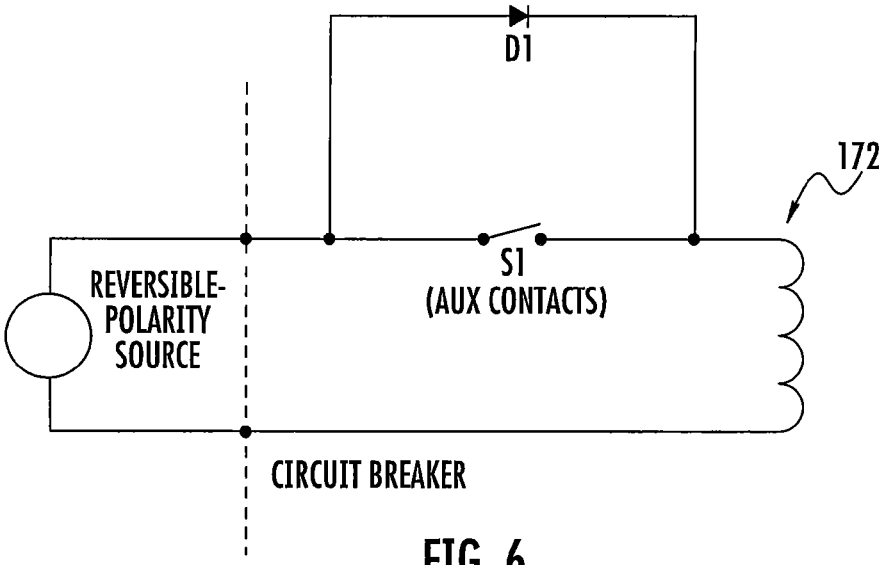
FIGS. 6 and 7 illustrate circuitry for driving a shunt trip mechanism according to further embodiments.
Figure 7:
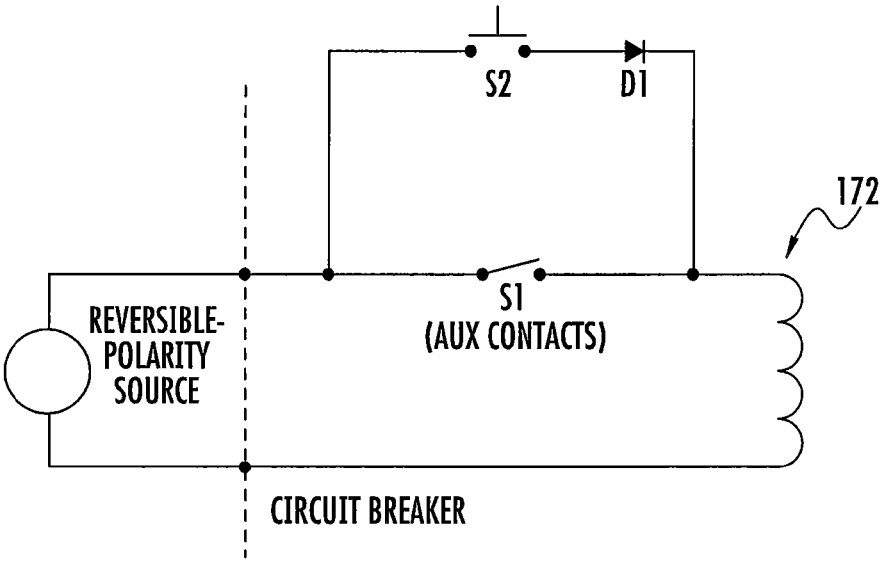

FIG. 6 illustrates exemplary circuitry for driving the coil 172. As discussed above, auxiliary contacts, here shown as a switch S1, may be used to interrupt current applied to the shunt trip coil 172 when a shunt trip voltage of a first polarity is applied from an external source. A parallel rectified path including, for example, a diode D1, allows current to flow through the coil 172 when a shunt trip voltage of an opposite polarity is applied. As shown, the external source may apply the shunt voltages via a momentary switch, for example, to prevent overheating of the coil 172. In some embodiments shown in FIG. 7, another cutoff switch S1 may be provided in the rectified path, obviating the need for the external source to limit the duration of the application of current to coil 172. This cutoff switch S2 may be, for example, a momentary relay or timer-controlled switch that operates responsive to the applied shunt trip voltage.

It will be appreciated that the embodiments described are provided for purposes of illustration, and that the inventive subject may be implemented in any of a variety of other ways. For example, the inventive subject matter may be implemented in other types of circuit breakers and/or may use polarity-sensitive shunt trip mechanism locking devices with different configurations. Such locking device may be, for example, spring or gravity actuated, in contrast to the magnetically activated mechanism described above.

In the drawings and specification, there have been disclosed exemplary embodiments of the inventive subject matter. Although specific terms are employed, they are used in a generic and descriptive sense only and not for purposes of limitation, the scope of the inventive subject matter being defined by the following claims.

That which is claimed:

1. A circuit breaker comprising:

at least one set of breaker contacts;

a contact actuating mechanism configured to open and close the at least one set of breaker contacts; and a polarity sensitive shunt trip mechanism mechanically coupled to the contact actuating mechanism and configured to lock the contact actuating mechanism responsive to a shunt trip voltage of a first polarity to prevent closing of the at least one set of breaker contacts and to unlock the contact actuating mechanism responsive to a shunt trip voltage of a second polarity to enable closing of the at least one set of breaker contacts, wherein the second polarity is opposite the first polarity.

2. The circuit breaker of claim 1, wherein the shunt trip mechanism comprises:

an actuator member configured to engage the contact actuating mechanism;

an electromagnet configured to receive the shunt trip voltages and to move the actuator member responsive thereto; and a locking device configured to impede movement of the actuator member.

3. A circuit breaker comprising:

at least one set of breaker contacts;

a contact actuating mechanism configured to open and close the at least one set of breaker contacts; and a polarity sensitive shunt trip mechanism mechanically coupled to the contact actuating mechanism and configured to lock the contact actuating mechanism responsive to a shunt trip voltage of a first polarity to prevent closing of the at least one set of breaker contacts and to unlock the contact actuating mechanism responsive to a shunt trip voltage of a second polarity to enable closing of the at least one set of breaker contacts, wherein the shunt trip mechanism comprises:

an actuator member configured to engage the contact actuating mechanism;

an electromagnet configured to receive the shunt trip voltages and to move the actuator member responsive thereto; and a locking device configured to impede movement of the actuator member, wherein the locking device is configured to be magnetically actuated by the electromagnet.

4. The circuit breaker of claim 2:

wherein the actuator member comprises an arm having an end that engages a moveable member of the contact actuating mechanism;

wherein the electromagnet is configured to attract the arm to pivot the arm about a pivot point to move the moveable member from a first position to a second position; and wherein the locking device is configured to constrain the arm to maintain the moveable member in the second position.

5. The circuit breaker of claim 4, wherein the locking device is configured to be magnetically actuated by the electromagnet.

6. The circuit breaker of claim 4:

wherein the shunt trip mechanism further comprises a shaft;

wherein the electromagnet comprises a coil disposed proximate a first end of the shaft;

wherein the arm comprises a plate having a first portion on a first side of a pivot point configured to engage the moveable member and a second portion on a second side of the pivot point and having an opening therein through which the shaft passes such that the opening moves along the shaft as the plate pivots; and wherein the locking device is configured to impede movement of the second portion of the plate with respect to the shaft.

7. The circuit breaker of claim 6, wherein the locking device comprises a latch configured to engage the second portion of the plate.

8. The circuit breaker of claim 7, wherein the latch comprises:

a flexible member disposed along the shaft and having a toothed portion extending therefrom in a direction perpendicular to an axis of the shaft; and a magnetic slide disposed on the shaft and configured to be drawn along the shaft towards the coil responsive to the shunt trip voltage of the first polarity to thereby displace the toothed portion of the flexible member away from the shaft and thereby engage the second portion of the plate with the toothed portion and to be forced away from the coil along the shaft responsive to the shunt trip voltage of the second polarity to release the flexible member and disengage the toothed portion from the second portion of the plate.

9. A shunt trip mechanism comprising:

an actuator member configured to engage a contact actuating mechanism;

an electromagnet configured to move the actuator member from a first position to a second position responsive to a shunt trip voltage of a first polarity; and a locking device configured to lock the actuator member in the second position and to enable movement of the actuator member from the second position to the first position responsive to a shunt trip voltage of a second polarity that is opposite the first polarity.

10. The shunt trip mechanism of claim 9, wherein the locking device is configured to be magnetically actuated by the electromagnet.

11. A shunt trip mechanism comprising:

an actuator member configured to engage a contact actuating mechanism;

an electromagnet configured to move the actuator member from a first position to a second position responsive to a shunt trip voltage of a first polarity; and a locking device configured to lock the actuator member in the second position and to enable movement of the actuator member from the second position to the first position responsive to a shunt trip voltage of a second polarity, wherein the actuator member comprises an arm having an end that engages a moveable member of the contact actuating mechanism;

wherein the electromagnet is configured to attract the arm to pivot the arm about a pivot point and thereby move the moveable member from a first position to a second position; and wherein the locking device is configured to constrain the arm to maintain the moveable member in the second position.

12. The shunt trip mechanism of claim 11, further comprising a shaft, wherein the electromagnet comprises a coil disposed proximate a first end of the shaft, wherein the arm comprises a plate having a first portion on a first side of a pivot point configured to engage the moveable member and a second portion on a second side of the pivot point and having an opening therein through which the shaft passes such that the opening moves along the shaft as the plate pivots, and wherein the locking device is configured to impede movement of the second portion of the plate with respect to the shaft.

13. The shunt trip mechanism of claim 12, wherein the locking device comprises a latch configured to engage the second portion of the plate.

14. The shunt trip mechanism of claim 13, wherein the latch comprises:

a flexible member disposed along the shaft and having a toothed portion extending therefrom in a direction perpendicular to an axis of the shaft; and a magnetic slide disposed on the shaft and configured to be drawn along the shaft towards the coil responsive to the shunt trip voltage of the first polarity to displace the toothed portion of the flexible member away from the shaft and thereby engage the second portion of the plate with the toothed portion and to be forced away from the coil along the shaft responsive to the shunt trip voltage of the second polarity to release the flexible member and disengage the toothed portion from the second portion of the plate.

15. A method of operating a circuit breaker, the method comprising:

applying a shunt trip voltage of a first polarity to a shunt trip mechanism to actuate a contact actuating mechanism;

locking the contact actuating mechanism using the shunt trip mechanism to prevent closing of at least one set of contacts controlled by the contact actuating mechanism; and releasing the contact actuating mechanism by applying a shunt trip voltage of a second polarity to the shunt trip mechanism, wherein the second polarity is opposite the first polarity.

16. The method of claim 15, wherein applying a shunt trip voltage of a first polarity to a shunt trip mechanism to actuate a contact actuating mechanism comprises applying the shunt trip voltage of the first polarity to an electromagnet of the shunt trip mechanism to move an actuator member that engages a moveable member of the contact actuating mechanism and thereby move the moveable member from a first position to a second position, and wherein locking the contact actuating mechanism using the shunt trip mechanism to prevent closing of at least one set of contacts comprises locking the actuator member to maintain the moveable member in the second position.

17. The method of claim 16, wherein locking the actuator member comprises magnetically actuating a locking device using the electromagnet.

* * * * *